US009316937B2

(12) United States Patent
Amemiya et al.

(10) Patent No.: US 9,316,937 B2
(45) **Date of Patent: *Apr. 19, 2016**

(54) TONER FOR ELECTROSTATIC IMAGE DEVELOPMENT

(71) Applicant: Konica Minolta, Inc., Tokyo (JP)

(72) Inventors: Taiki Amemiya, Tokyo (JP); Kaori Matsushima, Tokyo (KR); Junya Onishi, Tokyo (JP); Aya Shirai, Tokyo (JP); Takaki Kawamura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 39 days.

This patent is subject to a terminal disclaimer.

(21) Appl. No.: 14/311,933

(22) Filed: Jun. 23, 2014

(65) Prior Publication Data

US 2015/0017584 A1 Jan. 15, 2015

(30) Foreign Application Priority Data

Jun. 26, 2013 (JP) ..... 2013-133826

(51) Int. Cl.
*G03G 9/08* (2006.01)
*G03G 9/087* (2006.01)

(52) U.S. Cl.
CPC ..... *G03G 9/08755* (2013.01); *G03G 9/0806* (2013.01); *G03G 9/0825* (2013.01); *G03G 9/08711* (2013.01); *G03G 9/08795* (2013.01); *G03G 9/08797* (2013.01)

(58) Field of Classification Search
CPC ..... G03G 9/08711; G03G 9/08755
USPC ..... 430/109.3, 109.4
See application file for complete search history.

(56) References Cited

FOREIGN PATENT DOCUMENTS

| | | |
|---|---|---|
| JP | 06-194876 | 7/1994 |
| JP | 2006-276074 A | 10/2006 |
| JP | 2010-151996 A | 7/2010 |
| JP | 2011-197659 A | 10/2011 |

*Primary Examiner* — Mark A Chapman
(74) *Attorney, Agent, or Firm* — Lucas & Mercanti, LLP

(57) ABSTRACT

Provided is a toner for electrostatic image development that has good low-temperature fixability, also has long-term heat-resistant storage stability and can form an image with unevenness in gloss suppressed. The toner for electrostatic image development includes toner particles. The toner particles have a domain-matrix structure in which a first domain phase including a crystalline polyester resin A and a second domain phase including a crystalline polyester resin B are dispersed in a matrix phase including a vinyl resin. The average diameter of the first domain phase is 400 to 900 nm, and the average diameter of the second domain phase is 10 to 200 nm. The melting point of the crystalline polyester resin A and the melting point of the crystalline polyester resin B are each 95° C. or lower.

16 Claims, 1 Drawing Sheet

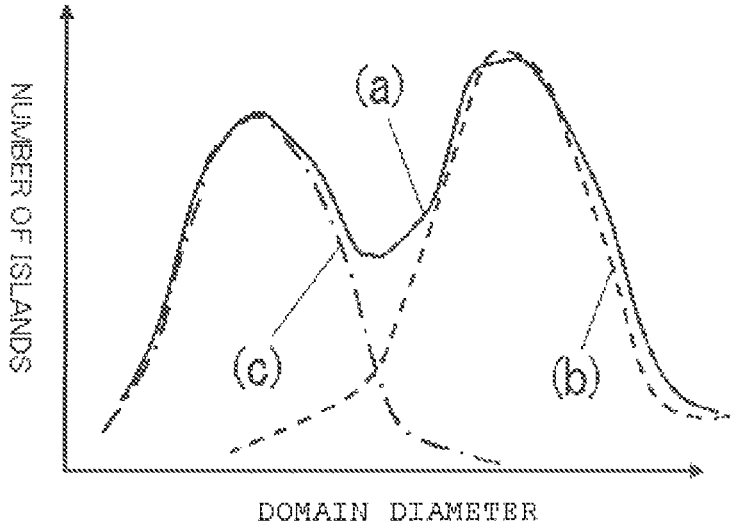
NUMBER OF ISLANDS
(a)
(c)
(b)
DOMAIN DIAMETER

TONER FOR ELECTROSTATIC IMAGE DEVELOPMENT

CROSS REFERENCE TO RELATED APPLICATION

This Application claims the priority of Japanese Patent Application No. 2013-133826 filed on Jun. 26, 2013, which is incorporated by reference herein.

TECHNICAL FIELD

The present invention relates to a toner for electrostatic image development that is used in image formation of an electrophotographic system.

BACKGROUND ART

To achieve higher energy saving in image forming apparatuses of an electrophotographic system, there is a need for a toner for electrostatic image development (hereinafter may be referred to simply as a "toner") that is heat-fixable at lower temperature.

Generally, the low-temperature fixability of a toner has a trade-off relation with heat-resistant storage stability, and there is a need for achieving both of them simultaneously. In recent years, as effective technical means for breaking the trade-off relation to improve low-temperature fixability, a method in which a crystalline polyester resin having sharp melting properties is introduced into toner particles is receiving attention.

Particularly, the most ideal form of the introduced crystalline polyester resin to improve its effect is a form in which the crystalline polyester resin in toner particles does not dissolve in a main resin before heat fixation such as during storage of the toner and does dissolve in the main resin during heat fixation. Since the crystalline polyester resin and the main resin dissolve in each other during heat fixation, the main resin is plasticized, so that a very high low-temperature fixation effect is obtained.

However, when a crystalline polyester resin highly compatible with the main resin is introduced into the toner particles, the crystalline polyester resin and the main resin dissolve in each other during production of the toner, so that the obtained toner generally does not have heat-resistant storage stability.

There is a description in Patent Literature 1 that introduction of a crystalline polyester resin into toner particles with the crystalline polyester resin not dissolving in a vinyl resin allows both low-temperature fixability and heat-resistant storage stability to be achieved simultaneously.

However, there is no description about means for dissolving the crystalline polyester resin and the vinyl resin in each other during heat fixation, and therefore it is not sufficient to allow fixation at lower temperature. In addition, there is a problem in that, when most of the crystalline polyester resin is present as an immiscible domain phase in an image after heat fixation, unevenness in gloss occurs in the formed image because of unevenness in size of the domain phase.

However, it is difficult to make a difference between the compatible state of the resins before heat fixation (for example, during storage of the toner) and the compatible state during heat fixation as described above, and there is a need for novel technical means for breaking the trade-off relation.

One possible novel technical means is to add a third component that facilitates dissolution of the crystalline polyester resin into the main resin during heat fixation.

Patent Literature 2 proposes that a compatibilizer having a reactive functional group such as stearyl stearate or glyceryl monostearate is added to a binder resin including a vinyl resin and a crystalline polyester resin.

However, the purpose of this technique is not to make a difference between the compatible state of the resins before heat fixation (for example, during storage of the toner) and the compatible state during heat fixation. Furthermore, addition of the low-molecular weight material likely to be compatible with the crystalline polyester resin may cause the dissolution to gradually proceed before heat fixation (for example, during storage of the toner) along with migration of the low-molecular weight material (molecular migration). Therefore, although short-term heat-resistant storage stability can be ensured, it is difficult to obtain long-term heat-resistant storage stability.

Patent Literature 3 proposes that a hybrid resin of an amorphous polyester resin and a vinyl resin that form a binder resin is added as a compatibilizer to the binder resin.

However, when the amorphous macromolecular material is selected as the compatibilizer, it takes a long time to allow the resins to dissolve in each other because the macromolecular material itself has a certain viscosity in a fixation temperature range, and it is not sufficient to obtain the effects of the compatibilizer in a short time.

Patent Literature 4 discloses a toner in which two types of crystalline polyester resins are used.

However, the aim of this technique is to introduce a highly elastic crystalline polyester resin as a third component to allow this crystalline polyester resin to function as a nucleating agent for the other crystalline polyester resin and is not to facilitate dissolution and plasticization during heat fixation.

CITATION LIST

Patent Literature

Patent Literature 1: Japanese Patent Application Laid-Open No. 2011-197659

Patent Literature 2: Japanese Patent Application Laid-Open No. 2006-276074

Patent Literature 3: Japanese Patent Application Laid-Open No. Hei. 6-194876

Patent Literature 4: Japanese Patent Application Laid-Open No. 2010-151996

SUMMARY OF INVENTION

Technical Problem

The present invention has been made on the basis of the foregoing circumstances and has as its object the provision of a toner for electrostatic image development that has good low-temperature fixability, also has long-term high heat-resistant storage stability and can form an image with unevenness in gloss suppressed.

Solution to Problem

To achieve at least one of the above mentioned objects, a toner for electrostatic image development reflecting one aspect of the present invention is a toner for electrostatic image development, comprising toner particles, wherein the toner particles have a domain-matrix structure in which a first domain phase comprising a crystalline polyester resin A and a second domain phase comprising a crystalline polyester resin B are dispersed in a matrix phase comprising a vinyl resin, an average diameter of the first domain phase is 400 to 900 nm, an average diameter of the second domain phase is 10 to 200 nm, and a melting point of the crystalline polyester resin A and a melting point of the crystalline polyester resin B are each 95° C. or lower.

In the above mentioned toner for electrostatic image development, the average diameter of the first domain phase may preferably be 550 to 700 nm, and the average diameter of the second domain phase may preferably be 20 to 120 nm.

In the above mentioned toner for electrostatic image development, the vinyl resin may preferably have a carboxy group concentration of 0.4 to 0.8 mmol/g, the crystalline polyester resin A may preferably have an ester group concentration of 4.6 to 5.5 mmol/g, and the crystalline polyester resin B may preferably have an ester group concentration of 6.4 to 7.7 mmol/g.

In the above mentioned toner for electrostatic image development, a difference between the ester group concentration in the crystalline polyester resin B and the ester group concentration in the crystalline polyester resin A may preferably be 1.0 to 3.0 mmol/g.

In the above mentioned toner for electrostatic image development, the vinyl resin may preferably has the carboxy group concentration of 0.5 to 0.7 mmol/g, the crystalline polyester resin A may preferably has the ester group concentration of 4.8 to 5.2 mmol/g, and the crystalline polyester resin B may preferably has the ester group concentration of 6.5 to 7.2 mmol/g.

In the above mentioned toner for electrostatic image development, a ratio of an amount of the crystalline polyester resin B with respect to a total amount of the resins constituting the toner particles may preferably be 2 to 5% by mass, and a ratio of the amount of the crystalline polyester resin B with respect to an amount of the crystalline polyester resin A may preferably be 10 to 25% by mass.

In the above mentioned toner for electrostatic image development, a ratio of an amount of the crystalline polyester resin A with respect to a total amount of the resins constituting the toner particles may preferably be 10 to 25% by mass.

In the above mentioned toner for electrostatic image development, a melting point of the crystalline polyester resin B may preferably be 65° C. or higher.

In the above mentioned toner for electrostatic image development, the melting point of the crystalline polyester resin B may preferably be 65 to 80° C., the melting point of the crystalline polyester resin A may preferably be 65 to 90° C., and a glass transition point of the vinyl resin may preferably be 35 to 65° C.

In the above mentioned toner for electrostatic image development, the toner particles may preferably further include a third domain phase comprising a parting agent, the third domain phase being dispersed in the matrix phase.

In the above mentioned toner for electrostatic image development, the toner for electrostatic image development may preferably be manufactured by an emulsion aggregation process.

Advantageous Effects of Invention

In the above mentioned toner for electrostatic image development, the toner particles have a domain-matrix structure in which domain phases composed of two respective types of crystalline polyester resins having different ester group concentrations and melting points in a specific range are dispersed in a matrix phase composed of a vinyl resin. Therefore, the toner has good low-temperature fixability, also has high heat-resistant storage stability for a long time, and can form an image with the occurrence of unevenness in gloss suppressed.

BRIEF DESCRIPTION OF DRAWING

FIG. 1 is a graph showing the number distribution of diameters of domain phases observed in a TEM image of cross sections of the toner particles according to the present invention, and also showing exemplary curves fitted to the peaks in the number distribution under the assumption that each peak follows a normal distribution.

DESCRIPTION OF EMBODIMENTS

The present invention will next be described in detail.

Toner:

The toner of the present invention includes toner particles containing at least a binder resin, and the toner particles may further contain internal additives such as a colorant, a magnetic powder, a parting agent and a charge control agent as needed. External additives such as a flowability improver and a cleaning aid may be added to the toner particles.

The toner particles according to the toner of the present invention have a domain-matrix structure in which domain phases are dispersed in a matrix phase. More specifically, a first domain phase composed of a crystalline polyester resin A and a second domain phase composed of a crystalline polyester resin B are independently formed in a matrix phase composed of a vinyl resin.

In the toner of the present invention, the average diameter of the first domain phase composed of the crystalline polyester resin A is 400 to 900 nm, preferably 550 to 700 nm.

When the average diameter of the first domain phase falls within the above range, the crystal line polyester resin A is less likely to dissolve in the vinyl resin before heat fixation (for example, during storage of the toner), so that heat-resistant storage stability can be ensured. During heat fixation, the crystalline polyester resin B constituting the second domain phase with a smaller average diameter dissolves first in the vinyl resin, and this causes the crystalline polyester resin A to dissolve in the vinyl resin through the crystalline polyester resin B. Good low-temperature fixability is thereby obtained.

If the average diameter of the first domain phase is excessively large, the crystalline polyester resin A is less likely to dissolve in the vinyl resin during heat fixation even in the present of the second domain phase with a smaller average diameter, so that good low-temperature fixability may not be obtained. If the average diameter of the first domain phase is excessively small, the crystalline polyester resin A is more likely to dissolve in the vinyl resin before heat fixation (for example, during storage of the toner), so that high heat-resistant storage stability may not be obtained.

The average diameter of the second domain phase composed of the crystalline polyester resin B is 10 to 200 nm, preferably 20 to 120 nm.

When the average diameter of the second domain phase falls within the above range, the crystalline polyester resin B immediately dissolves in the vinyl resin during heat fixation without impairing heat-resistant storage stability before heat fixation (for example, during storage of the toner). Therefore, the crystalline polyester resin B functions as a compatibilizer for the crystalline polyester resin A and the vinyl resin, so that good low-temperature fixability is obtained.

If the average diameter of the second domain phase is excessively large, the crystalline polyester resin B is less likely to first dissolve in the vinyl resin during heat fixation, so that good low-temperature fixability may not be obtained. If the average diameter of the second domain phase is excessively small, the crystalline polyester resin B is more likely to dissolve in the vinyl resin even before heat fixation (during storage of the toner), so that high heat-resistant storage stability may not be obtained.

In the present invention, the average diameter of a domain phase is a value measured in an image observed under a transmission electron microscope (TEM) as follows.

The domain diameters of 200 islands of the domain phase in the TEM image are measured. In this case, the domain diameter is defined as the average value of the horizontal Feret diameter and vertical Feret diameter of the domain phase. Next, the number distribution of the domain diameter is computed using a publicly known method. The number distribution has a peak in a small-diameter region and another peak in a large-diameter region. Curve fitting is performed on the number distribution under the assumption that each peak follows a normal distribution, and the values of the peak tops of the fitting curves are defined as the average diameters of the respective domain phases.

Specifically, as shown in FIG. 1, curve (a) represents the number distribution of the domain diameters of the domain phases in the TEM image. Curve (b) is a curve fitted to the peak in the large-diameter region in the number distribution under the assumption that the peak follows a normal distribution, and curve (c) is a curve fitted to the peak in the small-diameter region in the number distribution under the assumption that the peak follows a normal distribution. The values of the peak tops of the curves (b) and (c) are used as the average diameters of the respective domain phases.

The domain diameter of a domain phase can be controlled by adjusting the ester group concentration in the resin constituting the domain phase. More specifically, the relation between the carboxy group concentration in the vinyl resin constituting the matrix phase and the ester group concentration in a crystalline polyester resin constituting a domain phase determines the compatibility between the resins, and the size of the domain phase formed by phase separation during production of the toner is controlled by the degree of compatibility.

The domain-matrix structure is a structure in which a domain phase including closed boundaries (boundaries between phases) is present in a continuous matrix phase.

This structure can be observed in cross-sectioned toner particles stained with ruthenium (VIII) oxide or osmium (VIII) oxide under a transmission electron microscope (TEM) using a measurement method known per se in the art. When an ultramicrotome is used to cut a slice, the thickness of the slice is set to 100 nm.

In the toner of the present invention, the toner particles contain crystalline polyester resins having melting points within a specific range, and this basically provides high low-temperature fixability. The toner of the present invention contains the first domain phase having a large average diameter and the second domain phase independent of the first domain phase and having a small average diameter. During heat fixation, temperature becomes sufficiently higher than the melting points that fall within the specific range. In this case, the viscosities of the crystalline polyester resins A and B decrease significantly, and the crystalline polyester resins A and B that are not compatible with each other before heat fixation (for example, during production of the toner and storage of the toner) are suddenly allowed to dissolve in each other. The crystalline polyester resin B constituting the second domain phase with a small average diameter dissolves immediately in the vinyl resin, and this causes the crystalline polyester resin A to dissolve in the vinyl resin through the crystalline polyester resin B. More specifically, the crystalline polyester resin B forming the second domain phase with a small average diameter functions as a compatibilizer for the vinyl resin and the crystalline polyester resin A constituting the first domain phase with a large average diameter. Therefore, the vinyl resin is plasticized by both the crystalline polyester resin A and the crystalline polyester resin B, and good low-temperature fixability is thereby obtained. As described above, the toner of the present invention includes the first domain phase with a large average diameter and the second domain phase with a small average diameter and independent of the first domain phase. This allows a difference to be made between the dissolution states of the resins before heat fixation and during heat fixation.

Since the crystalline polyester resins are included, as the immiscible domain phases, in the matrix phase composed of the vinyl resin, heat-resistant storage stability is obtained. When the size of a domain phase is small, this domain phase tends to show high compatibility with the vinyl resin serving as the main resin. However, when the content of the crystalline polyester resin A constituting the first domain phase with a large average diameter is high, dissolution of the crystalline polyester resin B constituting the second domain phase with a small average diameter into the vinyl resin does not impair heat-resistant storage stability. The dissolution of the crystalline polyester resin B serving as the compatibilizer is less likely to proceed by migration as compared to dissolution of a low-molecular weight material, so that high heat-resistant storage stability can be ensured for a long time.

In addition, since the crystalline polyester resins have dissolved in the vinyl resin to a large extent in an image after heat fixation, the crystalline polyester resins are less likely to be present as large domain phases, so that the occurrence of unevenness in gloss due to variations in size of the domain phases is suppressed.

Binder Resin:

The binder resin constituting the toner particles according to the present invention comprises the vinyl resin forming the matrix phase and the crystalline polyester resins A and B forming the domain phases and may contain other resins.

Vinyl Resin:

The vinyl resin constituting the matrix phase is an amorphous resin formed using a monomer having a vinyl group (hereinafter may be referred to as a "vinyl monomer").

As examples of the vinyl resin, may be mentioned a styrene resin, an acrylic resin, and a styrene-acrylic copolymer resin.

The following monomers etc. can be used as the vinyl monomer. Such vinyl monomers may be used either singly or in any combination thereof.

(1) Styrene-Based Monomers

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, derivatives thereof, etc.

(2) (Meth)Acrylate-Based Monomers

Methyl(meth)acrylate, ethyl(meth)acrylate, n-butyl(meth)acrylate, isopropyl(meth)acrylate, isobutyl(meth)acrylate, t-butyl(meth)acrylate, n-octyl(meth)acrylate, 2-ethylhexyl(meth)acrylate, stearyl(meth)acrylate, lauryl(meth)acrylate, phenyl(meth)acrylate, diethylaminoethyl(meth)acrylate, dimethylaminoethyl(meth)acrylate, derivatives thereof, etc.

(3) Vinyl Esters

Vinyl propionate, vinyl acetate, vinyl benzoate, etc.

(4) Vinyl Ethers

Vinyl methyl ether, vinyl ethyl ether, etc.

(5) Vinyl Ketones

Vinyl methyl ketone, vinyl ethyl ketone, vinyl hexyl ketone, etc.

(6) N-Vinyl Compounds

N-vinylcarbazole, N-vinylindole, N-vinylpyrrolidone, etc.

(7) Others

Vinyl compounds such as vinylnaphthalene and vinylpyridine, derivatives of acrylic acid and methacrylic acid such as acrylonitrile, methacrylonitrile and acrylamide, etc.

The vinyl monomer used is preferably a monomer having an ionic leaving group such as a carboxy group, a sulfonate group or a phosphate group. Specific examples include the following monomers.

As examples of the monomer having a carboxy group, may be mentioned acrylic acid, methacrylic acid, maleic acid, itaconic acid, cinnamic acid, fumaric acid, maleic acid monoalkyl esters and itaconic acid monoalkyl esters. As examples of the monomer having a sulfonate group, may be mentioned styrenesulfonic acid, allyl sulfosuccinic acid and 2-acrylamide-2-methylpropane sulfonic acid. As examples of the monomer having a phosphate group, may be mentioned acidphosphoxyethyl methacrylate.

In the present invention, when the monomer having an ionic leaving group is used as the vinyl monomer, the ratio of the monomer having an ionic leaving group to all the vinyl monomers is preferably 2 to 7% by mass. If the ratio of the monomer having an ionic leaving group is excessively high, the amount of water adsorbed on the surface of the toner particles becomes large. In this case, toner blisters may occur, and the environmental difference in the amount of charge may increase.

In addition, a polyfunctional vinyl compound may be used as a vinyl monomer to allow the vinyl resin to have a cross-linked structure. As examples of the polyfunctional vinyl, may be mentioned divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate and neopentyl glycol diacrylate.

The carboxy group concentration in the vinyl resin is preferably 0.4 to 0.8 mmol/g, more preferably 0.5 to 0.7 mmol/g.

When the carboxy group concentration in the vinyl resin falls within the above range, the vinyl resin is less compatible with the crystalline polyester resin A but more compatible with the crystalline polyester resin B, in relation to the ester group concentrations in the crystalline polyester resins A and B described later. Therefore, during production of the toner, the first domain phase composed of the crystalline polyester resin A is formed as large islands in the matrix phase composed of the vinyl resin, and the second domain phase composed of the crystalline polyester resin B is formed as small islands. During heat fixation, the crystalline polyester resin B constituting the second domain phase with a small average diameter first dissolves in the vinyl resin, and the vinyl resin is thereby plasticized. Then the crystalline polyester resin A constituting the first domain phase with a large average diameter dissolves in the vinyl resin through the crystalline polyester resin B, and the vinyl resin is plasticized also by the crystalline polyester resin A, so that very good low-temperature fixability is obtained. Since the vinyl resin is less compatible with the crystalline polyester resin A, the crystalline polyester resin A does not plasticize the vinyl resin before heat fixation (for example, during storage of the toner), so that heat-resistant storage stability can be ensured. After heat fixation, the crystalline polyester resin A has dissolved in the vinyl resin to a large extent. Therefore, the crystalline polyester resin A is less likely to be present as large domain phases in the image after heat fixation, so that the occurrence of unevenness in gloss due to variations in size of the domain phases is suppressed.

If the carboxy group concentration in the vinyl resin is excessively high, the vinyl resin and the crystalline polyester resin A easily dissolve in each other, and high heat-resistant storage stability may not be obtained. If the carboxy group concentration in the vinyl resin is excessively low, the vinyl resin and the crystalline polyester resin B are less likely to dissolve in each other, and the crystalline polyester resin B does not function as a compatibilizer, so that good low-temperature fixability may not be obtained. In addition, since dissolution of the crystalline polyester resin into the vinyl resin does not proceed during heat fixation, the crystalline polyester resin may be recrystallized after heat fixation, and unevenness in gloss may occur in the image formed.

The carboxy group concentration is the ratio of carboxy groups in a vinyl resin and represents the affinity for water. The higher the value of the carboxy group concentration is, the higher the affinity for water is.

In the present invention, the carboxy group concentration is a value computed using the following formula (1):

carboxy group concentration=[the number of moles of carboxy groups/the sum of {the molecular weight of each monomer forming the vinyl resin×its molar fraction}]×1000. Formula (1)

The carboxy group concentration in the vinyl resin can be controlled by changing the introduction ratio of the monomer having a carboxy group.

The glass transition point (Tg) of the vinyl resin is preferably 35 to 65° C., more preferably 40 to 55° C.

When the glass transition point of the vinyl resin falls within the above range, both sufficient low-temperature fixability and heat-resistant storage stability are achieved simultaneously in a reliable manner.

If the glass transition point of the vinyl resin is excessively low, the heat resistance (thermal strength) of the toner deteriorates. In this case, sufficient heat-resistant storage stability and hot offset resistance may not be obtained. If the glass transition point of the vinyl resin is excessively high, sufficient low-temperature fixability may not be obtained.

The glass transition point (Tg) of a vinyl resin is a value measured using "Diamond DSC" (manufactured by PerkinElmer Co., Ltd.).

The procedure of the measurement will next be described. First, 3.0 mg of a measurement sample (the vinyl resin) is sealed in an aluminum-made pan, and the pan is placed in a holder. An empty aluminum-made pan is used as a reference. A Heat-cool-Heat cycle is performed in the measurement temperature range of 0° C. to 200° C. while the temperature is controlled under the measurement conditions of a temperature increase rate of 10° C./min and a temperature decrease rate of 10° C./min. Analysis is performed using data in the 2nd heating, and the intersection of the extension of a base line before the rising edge of a first endothermic peak and a tangential line representing the maximum inclination between the rising edge of the first endothermic peak and the top of the peak is used as the glass transition point.

The softening point (Tsp) of the vinyl resin is preferably 80 to 120° C., more preferably 85 to 110° C.

In the present invention, the softening point (Tsp) of a vinyl resin is a value measured as follows.

First, 1.1 g of a measurement sample (the vinyl resin) is placed in a petri dish in an environment of 20±1° C. and 50±5% RH and then is leveled off. After left to stand for 12 hours or longer, the measurement sample is pressurized using a press "SSP-10A" (manufactured by Shimadzu Corporation) at a pressure of 3,820 kg/cm$^2$ for 30 seconds to produce a cylindrical molded sample having a diameter of 1 cm. Then the molded sample is placed in a flow tester "CFT-500D" (manufactured by Shimadzu Corporation) in an environment of 24° C.±5° C. and 50%±20% RH. Under the conditions of a load of 196 N (20 kgf), a start temperature of 60° C., a preheating time of 300 seconds and a temperature increase rate of 6° C./min, the molded sample is extruded from the hole (1 mm diameter×1 mm) of a cylindrical die using a piston having a diameter of 1 cm after completion of preheating. An offset temperature $T_{offset}$ measured by a melting point measurement method using a temperature rise method at an offset value setting of 5 mm is used as the softening point.

The molecular weight, i.e., the weight average molecular weight (Mw), of the vinyl resin measured by gel permeation chromatography (GPC) is preferably 5,000 to 50,000, more preferably 20,000 to 40,000.

When the weight average molecular weight of the vinyl resin falls within the above range, low-temperature fixability can be ensured.

If the weight average molecular weight of the vinyl resin is excessively high, the elasticity of the vinyl resin is not sufficiently reduced during heat fixation. In this case, dissolution of the crystalline polyester resins into the vinyl resin is less likely to proceed, so that a sufficient low-temperature fixability effect may not be obtained. If the weight average molecular weight of the vinyl resin is excessively low, the elasticity of the vinyl resin becomes excessively low during heat fixation. In this case, a hot offset phenomenon may occur in which the fused toner is transferred from an image supporting medium to a fixing member, causing image roughness and separation failure.

The molecular weight measured by gel permeation chromatography (GPC) is a value measured as follows.

The molecular weight is measured using an apparatus "HLC-8120GPC" (manufactured by TOSOH Corporation) and a column "TSKguardcolumn+TSKgel SuperHZM-M (three in series)" (manufactured by TOSOH Corporation) in the flow of tetrahydrofuran (THF) used as a carrier solvent at a flow rate of 0.2 mL/min while the temperature of the column is held at 40° C. The measurement sample (the resin) is dissolved in tetrahydrofuran at a concentration of 1 mg/mL using an ultrasonic disperser. In this case, the dissolving treatment is performed at room temperature for 5 minutes. Next, the obtained solution is treated through a membrane filter having a pore size of 0.2 μm to obtain a sample solution, and 10 μL of the sample solution together with the above-described carrier solvent is injected into the apparatus. Detection is performed using a refractive index detector (RT detector), and the molecular weight distribution of the measurement sample is computed using a calibration curve determined using monodispersed polystyrene standard particles. Ten different types of polystyrene were used for the determination of the calibration curve.

The content of the vinyl resin in the binder resin is preferably 80 to 100% by mass.

When the content of the vinyl resin falls within the above range, the compatibility between the vinyl resin and the crystalline polyester resin A and the compatibility between the vinyl resin and the crystalline polyester resin B can be controlled to desired states, and a low-temperature fixability effect can be obtained with no reduction in heat-resistant storage stability.

Crystalline Polyester Resin A:

The crystalline polyester resin A constituting the first domain phase is any known polyester resin obtained by a polycondensation reaction of a divalent or higher carboxylic acid (polyvalent carboxylic acid) and a dihydric or higher alcohol (a polyhydric alcohol) and showing a clear endothermic peak rather than a stepwise endothermic change in differential scanning calorimetry (DSC). Specifically, the clear endothermic peak is an endothermic peak with a half-value width of 15° C. or less in differential scanning calorimetry (DSC) when the measurement is performed at a temperature increase rate of 10° C./min.

The polyvalent carboxylic acid is a compound having two or more carboxy groups in its molecule.

As specific examples of the polyvalent carboxylic acid, may be mentioned: saturated aliphatic dicarboxylic acids such as oxalic acid, malonic acid, succinic acid, adipic acid, sebacic acid, azelaic acid and n-dodecylsuccinic acid; alicyclic dicarboxylic acids such as cyclohexane dicarboxylic acid; aromatic dicarboxylic acids such as phthalic acid, isophthalic acid and terephthalic acid; trivalent or higher polyvalent carboxylic acids such as trimellitic acid and pyromellitic acid; and anhydrides and C1 to C3 alkyl esters of these carboxylic acid compounds.

These may be used either singly or in any combination thereof.

The polyhydric alcohol is a compound having two or more hydroxy groups in its molecule.

As specific examples of the polyhydric alcohol, may be mentioned: aliphatic diols such as 1,2-propanediol, 1,3-propanediol, 1,4-butanediol, 1,5-pentanediol, 1,6-hexanediol, 1,7-heptanediol, 1,8-octanediol, neopentyl glycol and 1,4-butenediol; and trihydric or higher alcohols such as glycerin, pentaerythritol, trimethylolpropane and sorbitol.

These may be used either singly or in any combination thereof.

The ester group concentration in the crystalline polyester resin A is preferably 4.6 to 5.5 mmol/g, more preferably 4.8 to 5.2 mmol/g.

When the ester group concentration in the crystalline polyester resin A falls within the above range, the crystalline polyester resin A is less likely to dissolve in the vinyl resin, in relation to the carboxy group concentration in the vinyl resin. In this case, high heat-resistant storage stability is obtained. In relation to the ester group concentration in the crystalline polyester resin B described later, the crystalline polyester resin A and the crystalline polyester resin B are less likely to dissolve in each other before heat fixation and easily dissolve in each other during heat fixation. Therefore, high heat-resistant storage stability and good low-temperature fixability are obtained.

The ester group concentration used herein is the ratio of ester groups (ester bonds) in a crystalline polyester resin and represents the degree of affinity for water. The higher the value of the ester group concentration is, the higher the affinity for water is.

In the present invention, the ester group concentration is a value computed using the following formula (2):

ester group concentration=[the average of the numbers of moles of portions capable of forming ester groups and included in the polyvalent carboxyl acid and the polyhydric alcohol forming the crystalline polyester resin/((the sum total of the molecular weight of the polyvalent carboxyl acid and the molecular weight of the polyhydric alcohol)−(the molecular weight of water separated by dehydration polycondensation×the number of moles of ester groups))]×1000 Formula (2)

The ester group concentration in the crystalline polyester resin can be controlled by changing the types of the monomers.

An example of the computation of the ester group concentration in a crystalline polyester resin is shown below.

A crystalline polyester resin obtained from a polyvalent carboxyl acid represented by the following formula (a) and a polyhydric alcohol represented by the following formula (b) is represented by the following formula (c).

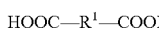

Formula (a)

Formula (b)

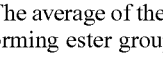

Formula (c)

"The average of the numbers of moles of portions capable of forming ester groups and included in the polyvalent carboxyl acid and the polyhydric alcohol forming the crystalline polyester resin" is the average of the number of moles of carboxy groups in the polyvalent carboxyl acid forming the crystalline polyester resin and the number of moles of hydroxyl groups in the polyhydric alcohol forming the crystalline polyester resin. More specifically, this value is the average of the number of moles of carboxy groups in the polyvalent carboxyl acid of formula (a), i.e., "2," and the number of moles of hydroxy groups in the polyhydric alcohol of formula (b), i.e., "2," and is therefore "2."

Let the molecular weight of the polyvalent carboxyl acid of the formula (a) be m1, the molecular weight of the polyhydric alcohol of the formula (b) be m2, and the molecular weight of the crystalline polyester resin of the formula (c) be m3. Then "(the sum total of the molecular weight of the polyvalent carboxyl acid and the molecular weight of the polyhydric alcohol)−(the molecular weight of water separated by dehydration polycondensation×the number of moles of ester groups)" is (m1+m2)−(18× the average number of moles of ester groups, i.e., "2") and is therefore equal to the molecular weight "m3" of the crystalline polyester resin of the formula (c).

Accordingly, the ester group concentration in the crystalline polyester resin represented by the formula (c) is "2/m3."

When two or more types of polyvalent carboxyl acids are used, the average of the numbers of moles of carboxy groups in the polyvalent carboxyl acids and the average of their molecular weights are used. When two or more types of polyhydric alcohols are used, the average of the numbers of moles of hydroxyl groups in the polyhydric alcohols and the average of their molecular weights are used.

The melting point (Tm) of the crystalline polyester resin A is preferably 95° C. or lower, more preferably 65 to 90° C.

When the melting point of the crystalline polyester resin A fails within the above range, sufficient low-temperature fixability is obtained.

If the melting point of the crystalline polyester resin A is excessively low, the crystalline polyester resin A may easily dissolve in the vinyl resin when the toner is stored in a high-temperature environment, so that sufficient heat-resistant storage stability may not be ensured. If the melting point of the crystalline polyester resin A is excessively high, sufficient low-temperature fixability may not be obtained.

The melting point of a crystalline polyester resin can be controlled by changing the resin composition.

The melting point of a crystalline polyester resin is a value measured as follows.

The melting point of a crystalline polyester is the temperature of the peak top of an endothermic peak and determined by DSC measurement in differential scanning calorimetry using "Diamond DSC" (manufactured by PerkinElmer Co., Ltd.).

More specifically, 1.0 mg of a measurement sample (crystalline polyester resin) is sealed in an aluminum-made pan (KITNO. B0143013), and the pan is placed in a sample holder of the "Diamond DSC." A heating-cooling-heating cycle is performed in the measurement temperature range of 0 to 200° C. while the temperature is controlled under the measurement conditions of a temperature increase rate of 10° C./min and a temperature decrease rate of 10° C./min. Analysis is performed using data in the second heating.

The molecular weight, i.e., the number average molecular weight (Mn), of the crystalline polyester resin A measured by gel permeation chromatography (GPC) is preferably 1,500 to 12,000.

The molecular weight of a crystalline polyester resin measured by gel permeation chromatography (GPC) are measured in the same manner as described above except that the crystalline polyester resin is used as the measurement sample.

The content of the crystalline polyester resin A in the binder resin is preferably 10 to 25% by mass, more preferably 12 to 20% by mass.

When the content of the crystalline polyester resin A falls within the above range, low-temperature fixability can be reliably obtained.

If the content of the crystalline polyester resin A is excessively low, a sufficient low-temperature fixability effect may not be obtained. If the content of the crystalline polyester resin A is excessively high, the crystalline polyester resin A does not sufficiently dissolve in the vinyl resin during heat fixation. In this case, the crystalline polyester resin A is likely to be present as large domain phases in an image after heat fixation, so that unevenness in gloss may occur.

Crystalline Polyester Resin B:

The crystalline polyester resin B constituting the second domain phase is any known polyester resin obtained by a polycondensation reaction of a divalent or higher carboxylic acid (polyvalent carboxylic acid) and a dihydric or higher alcohol (a polyhydric alcohol) and showing a clear endothermic peak rather than a stepwise endothermic change in differential scanning calorimetry (DSC). Specifically, the clear endothermic peak is an endothermic peak with a half-value width of 15° C. or less in differential scanning calorimetry (DSC) when the measurement is performed at a temperature increase rate of 10° C./min.

In the toner of the present invention, the crystalline polyester resin B constituting the second domain phase functions as the compatibilizer for the crystalline polyester resin A and the vinyl resin.

As examples of the polyvalent carboxylic acid and the polyhydric alcohol, may be mentioned the polyvalent carboxylic acids and the polyhydric alcohols exemplified for the crystalline polyester resin A.

Preferably, the ester group concentration in the crystalline polyester resin B is different from the ester group concentration in the crystalline polyester resin A.

The ester group concentration in the crystalline polyester resin B is preferably 6.4 to 7.7 mmol/g, more preferably 6.5 to 7.2 mmol/g.

When the ester group concentration in the crystalline polyester resin B falls within the above range, the crystalline polyester resin B is more likely to dissolve in the vinyl resin, in relation to the carboxy group concentration in the vinyl resin. Therefore the crystalline polyester resin B functions as a compatibilizer, and good low-temperature fixability is obtained. In relation to the ester group concentration in the crystalline polyester resin A, the crystalline polyester resin B and the crystalline polyester resin A are less likely to dissolve in each other before heat fixation but easily dissolve in each other during heat fixation. Therefore, high heat-resistant storage stability and good low-temperature fixability are obtained.

The difference between the ester group concentration B1 in the crystalline polyester resin B and the ester group concentration A1 in the crystalline polyester resin A, i.e., (B1−A1), is preferably 1.0 to 3.0 mmol/g.

When the difference in ester group concentration (B1−A1) falls within the above range, the crystalline polyester resins A and B are not compatible with each other before heat fixation (during production of the toner and storage of the toner) and are compatible with each other during heat fixation, so that high heat-resistant storage stability and good low-temperature fixability are obtained.

If the difference in ester group concentration (B1−A1) is excessively low, the crystalline polyester resins A and B are compatible with each other even before heat fixation, and high heat-resistant storage stability may not be obtained. If the difference in ester group concentration (B1−A1) is excessively high, dissolution of the crystalline polyester resins A and B is less likely to proceed during heat fixation, and good low-temperature fixability may not be obtained.

The melting point (Tm) of the crystalline polyester resin B is 95° C. or lower, preferably 65 to 80° C.

When the melting point of the crystalline polyester resin B falls within the above range, sufficient low-temperature fixability is obtained.

If the melting point of the crystalline polyester resin B is excessively low, the crystalline polyester resins A and B dissolve in each other even before heat fixation, and high heat-resistant storage stability may not be obtained. If the melting point of the crystalline polyester resin B is excessively high, sufficient low-temperature fixability may not be obtained.

The molecular weight, i.e., the number average molecular weight (Mn), of the crystalline polyester resin B measured by gel permeation chromatography (GPC) is preferably 1,500 to 10,000.

The ratio of the amount of the crystalline polyester resin B with respect to the amount of the binder resin is preferably 2 to 5% by mass. The ratio of the amount of the crystalline polyester resin B with respect to the amount of the crystalline polyester resin A is preferably 10 to 25% by mass.

When the ratios of the amount of the crystalline polyester resin B fall within the above ranges, its function as a compatibilizer is exerted. In this case, while good low-temperature fixability is obtained, heat-resistant storage stability is not impaired.

If the ratios of the amount of the crystalline polyester resin B are excessively low, its function as a compatibilizer is not sufficiently exerted, so that good low-temperature fixability may not be obtained. If the ratios of the amount of the crystalline polyester resin B are excessively high, dissolution of the crystalline polyester resin 3 into the vinyl resin proceeds excessively before heat fixation, so that high heat-resistant storage stability may not be obtained.

Colorant:

In the toner of the present invention, when the toner particles are configured to contain a colorant, the colorant may be contained in any of the matrix phase and the domain phases, but it may preferably be contained in the matrix phase.

Any of various colorants such as dyes and pigments can be used as the colorant.

As examples of the carbon black, may be mentioned channel black, furnace black, acetylene black, thermal black and lamp black. As examples of black iron oxide, may be mentioned magnetite, hematite and iron titanium trioxide.

As examples of the dye, may be mentioned C.I. Solvent Red: 1, 49, 52, 58, 63, 111 and 122, C.I. Solvent Yellow: 19, 44, 77, 79, 81, 82, 93, 98, 103, 104, 112 and 162 and C.I. Solvent Blue: 25, 36, 60, 70, 93 and 95.

As examples of the pigment, may be mentioned C.Z. Pigment Red: 5, 48:1, 48:3, 53:1, 57:1, 81:4, 122, 139, 144, 149, 150, 166, 177, 178, 222, 238 and 269, C.I. Pigment Orange: 31 and 43, C.I. Pigment Yellow: 14, 17, 74, 93, 94, 138, 155, 156, 158, 180 and 185, C.I. Pigment Green: 7 and C.I. Pigment Blue: 15:3 and 60.

One colorant or a combination of two or more colorants may be used for a color toner.

The content of the colorant in the toner particles is preferably 1 to 10% by mass, more preferably 2 to 8% by mass. If the content of the colorant is excessively small, the toner obtained may not have the desired coloring power. If the content of the colorant is excessively large, the colorant may be separated or adhere to a carrier etc., and this may affect charge property.

Parting Agent:

In the toner of the present invention, when the toner particles are configured to contain a parting agent, the parting agent may be contained in any of the matrix phase and the domain phases, but it may preferable contained in the matrix phase. When the parting agent is dispersed in the matrix phase as a third domain phase, it is preferable that the average diameter of the third domain phase composed of the parting agent is 0.1 to 1.0 m.

Any of various publicly known waxes may be used as the parting agent.

Any of polyolefin-based waxes such as low-molecular weight polypropylene wax, low-molecular weight polyethylene wax, oxidized-type polypropylene wax and oxidized-type polyethylene wax and ester-based waxes such as behenic acid behenate wax can be particularly preferably used.

As specific examples of the wax, may be mentioned: polyolefin waxes such as polyethylene wax and polypropylene wax; branched chain hydrocarbon waxes such as microcrystalline wax; long chain hydrocarbon-based waxes such as paraffin wax and Sasol wax; dialkyl ketone-based waxes such as distearyl ketone; ester-based waxes such as carnauba wax, montan wax, behenic acid behenate, trimethylolpropane tribehenate, pentaerythritol tetrabehenate, pentaerythritol diacetate dibehenate, glycerin tribehenate, 1,18-octadecanediol distearate, tristearyl trimellitate and distearyl maleate; and amide-based waxes such as ethylenediamine behenylamide and tristearyl trimellitate amide.

Of these, a wax having a low melting point, i.e., a melting point of 40 to 90° C., is preferably used from the viewpoint of releasability during low-temperature fixation.

The content of the parting agent in the toner particles is preferably 5 to 25% by mass, more preferably 8 to 18% by mass. When the content of the parting agent in the toner particles falls within the above range, releasability and fixability can be achieved simultaneously in a reliable manner.

Charge Control Agent:

In the toner of the present invention, when the toner particles are configured to contain a charge control agent, the charge control agent may be contained in any of the matrix phase and the domain phases, but it may preferably be contained in the matrix phase.

Any of various publicly known compounds may be used as the charge control agent.

The content of the charge control agent in the toner particles is preferably 0.01 to 30% by mass, more preferably 0.1 to 10% by mass.

External Additives:

The toner particles in the toner of the present invention can be used as the toner without adding any additive. However, to improve flowability, charge property, cleanability, etc., external additives such as a flowability improver and a cleaning aid may be added to the toner particles.

A combination of various external additives may be used.

The ratio of the total amount of the external additives added is preferably 0.05 to 5 parts by mass, more preferably 0.1 to 3 parts by mass per 100 parts by mass of the toner particles.

Glass Transition Point of Toner:

The toner of the present invention has a glass transition point (Tg) of preferably 30 to 60° C., more preferably 35 to 55° C.

When the glass transition point of the toner of the present invention falls within the above range, sufficient low-temperature fixability and heat-resistant storage stability are obtained simultaneously in a reliable manner. If the glass transition point of the tonner is excessively low, the heat resistance (thermal strength) of the toner deteriorates. In this case, sufficient heat-resistant storage stability and hot offset resistance may not be obtained. If the glass transition point of the toner is excessively high, sufficient low-temperature fixability may not be obtained.

The glass transition point of the toner is measured in the same manner as described above except that the toner is used as the measurement sample.

Particle Diameter of Toner:

The average particle diameter, for example, the volume-based median diameter, of the toner of the present invention is preferably 3 to 8 μm, more preferably 5 to 8 μm. The average particle diameter can be controlled by changing the concentration of an aggregating agent used for production of the toner, the amount added of an organic solvent, fusion-bonding time, the chemical composition of the binder resin, etc.

When the volume-based median diameter falls within the above range, a very fine dot image of 1200 dpi can be faithfully reproduced.

The volume-based median diameter of the toner is measured and computed using a measuring device composed of "Multisizer 3" (manufactured by Beckman Coulter, Inc.) and a computer system connected thereto and equipped with data processing software "Software V3.51." More specifically, 0.02 g of a measurement sample (the toner) is added to 20 mL of a surfactant solution (a surfactant solution used for the purpose of dispersing the toner particles and prepared, for example, by diluting a neutral detergent containing a surfactant component ten-fold with pure water) and is left to stand. The obtained solution is subjected to ultrasonic dispersion for 1 minute to prepare a dispersion of the toner. This toner dispersion is added with a pipette to a beaker containing "ISOTON II" (manufactured by Beckman Coulter, Inc.) nd held in a sample stand until the concentration displayed in the measuring device reaches 8%. By using the above concentration range, a reproducible measurement value can be obtained. In the measuring device, the number of particles to be counted is set to 25,000, and the diameter of an aperture is set to 100 μm. The range of measurement, a 2 to 60 μm range, is divided into 256 sections, and a frequency value in each section is computed. The particle size when a cumulative volume fraction cumulated from the large-diameter side reaches 50% is used as the volume-based median diameter.

Average Circularity of Toner:

In the toner of the present invention, the average circularity of the toner particles included in the toner is preferably 0.930 to 1.000, more preferably 0.950 to 0.995 from the viewpoint of stability of electrification characteristics and low-temperature fixability.

When the average circularity falls within the above range, individual toner particles are less likely to be broken. Therefore, contamination of a triboelectrifying member is suppressed, so that the charge property of the toner are stabilized. In addition, the quality of a formed image becomes high.

The average circularity of the toner is a value measured using "FPIA-2100" (manufactured by Sysmex Corporation).

More specifically, a measurement sample (the toner) is left to stand in a surfactant-containing aqueous solution and then subjected to ultrasonic dispersion treatment for 1 minute to disperse the toner. Then images of the toner are taken using the "FPIA-2100" (manufactured by Sysmex Corporation) in an HPF (high-power field) measurement mode at an appropriate concentration in which the number of particles detected in the HPF mode is 3,000 to 10,000. The circularity of each of the toner particles is computed using the following formula (y). The computed circularity values of the toner particles are summed up, and the sum total is divided by the total number of toner particles to compute the average circularity. When the number of particles detected in the HPF mode falls within the above range, reproducibility is obtained.

circularity=(the circumferential length of a circle having the same area as the projected area of a particle image)/(the circumferential length of the projected particle image) Formula (y)

Developer:

The toner of the present invention can be used as a magnetic or non-magnetic one-component developer or may be mixed with a carrier and used as a two-component developer. When the toner is used as a two-component developer, the carrier used may be magnetic particles of a publicly known material such as a metal, for example, iron, ferrite or magnetite or an alloy of any of these metals with a metal such as aluminum or lead. Ferrite particles are particularly preferred. The carrier used may be a coated carrier prepared by coating the surface of magnetic particles with a coating agent such as a resin or a dispersion-type carrier prepared by dispersing a fine magnetic powder in a binder resin.

The volume-based median diameter of the carrier is preferably 20 to 100 μm, more preferably 25 to 80 μm. A representative example of the device used to measure the volume-based median diameter of the carrier is a laser diffraction-type particle size distribution measuring device "HELOS" (manufactured by SYMPATEC) equipped with a wet-type disperser.

In the present invention, to examine the carboxy group concentration in the vinyl resin and the ester group concentrations in the crystalline polyester resins, the vinyl resin and crystalline polyester resins contained in the toner particles must be extracted. More specifically, the resins can be extracted from the toner particles as follows.

First, the toner is dissolved in methyl ethyl ketone (MEK) at room temperature (20° C. or higher and 25° C. or lower). In this case, the resins in amorphous form (the vinyl resins in the toner particles dissolve in MEK at room temperature. Therefore, the components dissolved in MEK include the resins in amorphous form, and the dissolved resins in amorphous form are obtained from a supernatant separated by centrifugation. The solids after centrifugation are heated at 65° C. for 60 minutes and dissolved in tetrahydrofuran (THF). The resultant solution is filtrated through a glass filter at 60° C., and a crystalline polyester resin mixture (sample R1) including the crystalline polyester resin A and the crystalline polyester resin B is obtained from the filtrate. If the temperature decreases during filtration in the above procedure, the crystalline polyester resins precipitate. Therefore, the procedure is performed while the temperature is maintained.

In the above procedure, when the temperature is maintained at 55° C. to slightly precipitate the crystalline polyester resins, a crystalline polyester resin precipitate (sample R2) composed mainly of the crystalline polyester resin A and containing almost no crystalline polyester resin B is obtained.

The carboxy group concentration in the vinyl resin can be determined by, for example, 12C-NMR (nuclear magnetic resonance) measurement using deuteriochloroform. More specifically, peaks of carbon atoms originating from the respective monomers are identified, and the types of monomers and the compositional ratio thereof are specified to compute the carboxy group concentration.

The ester group concentrations in the crystalline polyester resins can be determined by hydrolyzing the crystalline polyester resins, performing measurement by P-GC/MS, and specifying the types of acid and alcohol monomers to compute the ester group concentrations.

The above measurement is performed on each of the samples R1 and R2. Monomer species clearly observed in the sample R1 but almost not observed in the sample R2 are monomer species originating from the crystalline polyester resin B.

Production Process of Toner:

As examples of the production process of the toner of the present invention, which is not limited to particular ones, may be mentioned a wet production process, such as an emulsion aggregation process, in which the toner is produced in a water-based medium.

In the production process of the toner of the present invention using the emulsion aggregation process, a water-based dispersion containing fine particles of the binder resin (hereinafter may be referred to as "fine binder resin particles") dispersed in a water-based medium is mixed with a water-based dispersion containing fine particles of the colorant (hereinafter may be referred to as "fine colorant particles"). Then the fine binder resin particles and the fine colorant particles are aggregated and heat-fused to form toner particles, whereby the toner is produced.

One example of the production process of the toner of the present invention will be described specifically.

The production process includes:

(a) a step of preparing a water-based dispersion containing fine particles of the vinyl resin (hereinafter may be referred to as "fine vinyl resin particles") dispersed in a water-based medium;

(b) a step of preparing a water-based dispersion containing fine colorant particles dispersed in a water-based medium;

(c) a step of preparing a water-based dispersion containing fine particles of the crystalline polyester resin A (hereinafter may be referred to as "fine crystalline polyester resin particles A") dispersed in a water-based medium;

(d) a step of preparing a water-based dispersion containing fine particles of the crystalline polyester resin B (hereinafter may be referred to as "fine crystalline polyester resin particles B") dispersed in a water-based medium;

(e) a step of aggregating and fusion-bonding the fine vinyl resin particles, the fine crystalline polyester resin particles A, the fine crystalline polyester resin particles B and the fine colorant particles in a water-based medium to form toner particles;

(f) a step of aging the toner particles using thermal energy to control their shape;

(g) a step of cooling the dispersion of the toner particles;

(h) a step of separating the toner particles from the water-based medium by filtration to remove a surfactant etc. from the toner particles;

(i) a step of drying the washed toner particles; and (j) an optional step of adding external additives to the dried toner particles.

A "water-based dispersion" used herein is a dispersion containing a dispersoid (fine particles) dispersed in a water-based medium, and the water-based medium is a medium composed mainly of water (50% by mass or more). A component other than water may be an organic solvent soluble in water. As examples of such an organic solvent, may be mentioned methanol, ethanol, isopropanol, butanol, acetone, methyl ethyl ketone and tetrahydrofuran. Of these, alcohol-based organic solvents such as methanol, ethanol, isopropanol and butanol that are organic solvents not dissolving the resins are particularly preferred.

(a) Step of Preparing Water-Based Dispersion of Fine Vinyl Resin Particles:

In this step, the water-based dispersion of the fine vinyl resin particles composed of the vinyl resin is prepared.

The water-based dispersion of the fine vinyl resin particles can be prepared by a miniemulsion polymerization process using the vinyl monomer for obtaining the vinyl resin. More specifically, for example, the vinyl monomer is added to a water-based medium containing a surfactant, and mechanical energy is applied thereto to form liquid droplets. Then a polymerization reaction is allowed to proceed in the liquid droplets via radicals from a water-soluble radical polymerization initiator. The liquid droplets may contain an oil-soluble polymerization initiator. The water-based dispersion of the fine vinyl resin particles composed of the vinyl resin can thereby be prepared.

The fine vinyl resin particles composed of the vinyl resin may have a multilayer structure including two or more layers composed of vinyl resins with different compositions. The fine vinyl resin particles having such a structure, for example, a two-layer structure, can be obtained by the following process. A dispersion of fine resin particles is prepared by emulsion polymerization treatment (first polymerization) known per se in the art, and a polymerization initiator and a vinyl monomer are added to the dispersion. Then the resultant system is subjected to polymerization treatment (second polymerization).

Surfactant:

The surfactant used in this step may be any of various publicly known surfactants such as anionic surfactants, cationic surfactants and nonionic surfactants.

Polymerization Initiator:

The polymerization initiator used in this step may be any of various publicly known polymerization initiators. As specific preferred examples of the polymerization initiator, may be mentioned persulfates (for example, potassium persulfate and ammonium persulfate). In addition, any of azo-based compounds (for example, 4,4'-azobis-4-cyanovaleric acid and salts thereof and 2,2'-azobis(2-amidinopropane) salts), peroxide compounds and azobisisobutyronitrile may be used.

Chain Transfer Agent:

In this step, any generally used chain transfer agent may be used for the purpose of controlling the molecular weight of the vinyl resin. No particular limitation is imposed on the chain transfer agent, and as examples thereof, may be mentioned 2-chloroethanol, mercaptans such as octyl mercaptan, dodecyl mercaptan and t-dodecyl mercaptan and a styrene dimer.

If necessary, the toner particles according to the present invention may contain other internal additives such as a parting agent and a charge control agent. Such internal additives may be introduced into the toner particles by, for example, dissolving or dispersing the internal additives in the solution of the vinyl monomer for forming the vinyl resin in advance in this step.

Such internal additives may also be introduced into the toner particles as follows. A dispersion of fine internal additive particles composed only of the internal additives is prepared separately. Then the internal additive particles are aggregated together with other fine particles in the step of forming toner particles. However, it is preferable to use the method in which the internal additives are introduced in advance in this step.

The average particle diameter, i.e., the volume-based median diameter, of the fine vinyl resin particles is preferably within the range of 100 to 250 nm.

The volume-based median diameter of the fine resin particles is a value measured using "Microtrac UPA-150" (manufactured by NIKKISO Co., Ltd.).

(b) Step of Preparing Water-Based Dispersion of Fine Colorant Particles:

This step is an optional step performed as needed when toner particles containing a colorant are desired. In this step, the colorant in a fine particle form is dispersed in a water-based medium to prepare a water-based dispersion of the fine colorant particles.

The water-based dispersion of the fine colorant particles is obtained by dispersing the colorant in a water-based medium containing a surfactant at a critical micelle concentration (CMC) or higher.

The colorant may be dispersed by utilizing mechanical energy, and no particular limitation is imposed on the disperser used. As preferred examples of the disperser, may be mentioned an ultrasonic disperser, a mechanical homogenizer, pressurizing dispersers such as a Manton-Gaulin homogenizer and a pressure-type homogenizer and medium-type dispersers such as a sand grinder, a Getzmann mill and a diamond fine mill.

The dispersed fine colorant particles have a volume-based median diameter of preferably 10 to 300 nm, more preferably 100 to 200 nm, particularly preferably 100 to 150 nm.

The volume-based median diameter of the fine colorant particles is a value measured using an electrophoretic light-scattering photometer "ELS-800" (manufactured by Otsuka Electronics Co., Ltd.).

(c) Step of Preparing Water-Based Dispersion of Fine Crystalline Polyester Resin Particles a:

In this step, the water-based dispersion of the fine crystalline polyester resin particles A formed of the crystalline polyester resin A is prepared.

The water-based dispersion of the fine crystalline polyester resin particles A can be prepared by first synthesizing the crystalline polyester resin A and dispersing the crystalline polyester resin A in fine particle form in a water-based medium.

As examples of the method of dispersing the crystalline polyester resin A in the water-based medium, may be mentioned a method including dissolving or dispersing the crystalline polyester resin A in an organic solvent to prepare an oil phase solution, dispersing the oil phase solution in a water-based medium by, for example, phase inversion emulsification to form oil droplets with their particle diameter controlled to the desired value, and then removing the organic solvent.

The amount used of the water-based medium is preferably 50 to 2,000 parts by mass, more preferably 100 to 1,000 parts by mass per 100 parts by mass of the oil phase solution.

For the purpose of improving the dispersion stability of the oil droplets, a surfactant etc. may be added to the water-based medium. As examples of the surfactant, may be mentioned those exemplified in the above step.

The organic solvent used to prepare the oil phase solution is preferably a low-boiling point solvent with low solubility in water, from the viewpoint of ease of removal after formation of the oil droplets. As specific examples of such a solvent, may be mentioned methyl acetate, ethyl acetate, methyl ethyl ketone, methyl isobutyl ketone, toluene and xylene. These solvents may be used either singly or in any combination thereof. The amount used of the organic solvent is generally 1 to 300 parts by mass, preferably 1 to 100 parts by mass, more preferably 25 to 70 parts by mass per 100 parts by mass of the crystalline polyester resin.

Emulsification and dispersion of the oil phase solution may be performed by utilizing mechanical energy. No particular limitation is imposed on the disperser used for emulsification and dispersion. As examples of the disperser, may be mentioned a low-speed shear disperser, a high-speed shear disperser, a frictional disperser, a high-pressure jet disperser and an ultrasonic disperser. As specific examples of the disperser, may be mentioned a TK-type homomixer (manufactured by Tokushu Kika Kogyo Co., Ltd.).

The dispersion diameter of the oil droplets is preferably 60 to 1,000 nm, more preferably 80 to 500 nm.

The dispersion diameter of the oil droplets is a volume-based median diameter measured using a laser diffraction/scattering particle size distribution measurement device "LA-750" (manufactured by HORIBA Ltd.). The dispersion diameter of the oil droplets can be controlled by changing the mechanical energy during emulsification dispersion.

The average particle diameter, i.e., the volume-based median diameter, of the fine crystalline polyester resin particles A is preferably within the range of 80 to 230 nm.

The volume-based median diameter of the fine crystalline polyester resin particles A is a value measured using "Microtrac UPA-150" (manufactured by NIKKISO Co., Ltd.).

(d) Step of Preparing Water-Based Dispersion of Fine Crystalline Polyester Resin Particles B:

In this step, the water-based dispersion of the fine crystalline polyester resin particles B composed of the crystalline polyester resin B is prepared.

The water-based dispersion of the fine crystalline polyester resin particles B can be produced by the same process as the above-described process for obtaining the water-based dispersion of the fine crystalline polyester resin particles A composed of the crystalline polyester resin A.

The average particle diameter, i.e., the volume-based median diameter, of the fine crystalline polyester resin particles B is preferably within the range of 80 to 230 nm.

The volume-based median diameter of the fine crystalline polyester resin particles B is a value measured using "Microtrac UPA-150" (manufactured by NIKKISO Co., Ltd.).

(e) Step of Forming Toner Particles

In this step, the fine vinyl resin particles, the fine crystalline polyester resin particles A, the fine crystalline polyester resin particles B and, if necessary, fine colorant particles are aggregated and further fusion-bonded by heat to form toner particles.

More specifically, an aggregating agent is added at a concentration equal to or higher than a critical aggregation concentration to a water-based dispersion containing the above-described fine particles dispersed in a water-based medium, and the mixture is heated to aggregate and fusion-bond the fine particles.

The fusion bonding temperature is, for example, 70 to 95° C.

In the production process in the water-based dispersion, when the fusion bonding temperature falls within the above range, the mixture is not heated to a temperature much higher than the preferred range (65 to 95° C.) of the melting point of the crystalline polyester resin B, so that excessive dissolution of the crystalline polyester resin B in the vinyl resin during production can be suppressed.

In this step, the fine crystalline polyester resin particles A and the fine crystalline polyester resin particles B individually form the respective domain phases, or pluralities of fused fine crystalline polyester resin particles A and pluralities of fused fine crystalline polyester resin particles B form the respective domain phases. Because of the relation between the carboxy group concentration in the vinyl resin and the ester group concentrations in the crystalline polyester resins, the fine crystalline polyester resin particles A composed of the crystalline polyester resin A are less likely to dissolve in the vinyl resin, and therefore large islands of the domain phase of the crystalline polyester resin A are formed. Since the fine crystalline polyester resin particles B composed of the crystalline polyester resin B are more likely to dissolve in the vinyl resin, small islands of the domain phase of the crystalline polyester resin B are formed.

Aggregating Agent:

No particular limitation is imposed on the aggregating agent used in this step. An aggregating agent selected from metal salts such as salts of alkali metals and salts of alkaline-earth metals is preferably used. As examples of the metal salts, may be mentioned: salts of monovalent metals such as sodium, potassium and lithium; salts of divalent metals such as calcium, magnesium, manganese and copper; and salts of trivalent metals such as iron and aluminum. As specific examples of the metal salts, may be mentioned sodium chloride, potassium chloride, lithium chloride, calcium chloride, magnesium chloride, zinc chloride, copper sulfate, magnesium sulfate and manganese sulfate. Of these, salts of divalent metals are particularly preferably used because only a small amount of such a salt allows aggregation to proceed. These may be used either singly or in any combination thereof.

(f) Aging Step:

This step is performed as needed. In the aging step, the toner particles obtained in the toner particle forming step are aged using thermal energy until the desired shape is obtained.

More specifically, the aging treatment is performed by heating and stirring the system containing the toner particles dispersed therein. The aging treatment is performed until the toner particles have the desired circularity while the heating temperature, stirring rate, heating time, etc. are controlled.

(g) Cooling Step:

In this step, the dispersion of the toner particles is subjected to cooling treatment. Preferably, the cooling treatment is performed under the condition of a cooling rate of 1 to 20° C./min.

No particular limitation is imposed on the specific method for cooling treatment. As examples of the method, may be mentioned a cooling method in which a coolant is introduced from the outside of a reaction container and a cooling method in which cold water is directly introduced into the reaction system.

(h) Filtration and Washing Step:

In this step, the cooled dispersion of the toner particles is subjected to solid-liquid separation to separate the toner particles, and a toner cake obtained by solid-liquid separation (cake-like wet aggregates of the associated toner particles) is washed to remove adhering materials such as the surfactant and the aggregating agent.

No particular limitation is imposed on the solid-liquid separation method, and any of a centrifugation method, a vacuum filtration method using, for example, a suction funnel and a filtration method using, for example, a filter press may be used. Preferably, washing is performed with water until the electric conductivity of the filtrate becomes 10 μS/cm.

(i) Drying Step:

In this step, the toner cake subjected to washing treatment is dried. This step may be performed according to a general drying step used in a publicly known production process of toner particles.

As specific examples of the dryer used to dry the toner cake, may be mentioned a spray dryer, a vacuum freeze dryer and a vacuum dryer. Preferably, any of a stationary shelf dryer, a movable shelf dryer, a fluidized-bed dryer, a rotary dryer and a stirring dryer is used.

The content of water in the dried toner particles is preferably 5% by mass or lower, more preferably 2% by mass or lower. When the dried toner particles are aggregated together through weak interparticle attractive force, the aggregates may be subjected to pulverization treatment. The pulverizer used may be a mechanical pulverizer such as a jet mill, a Henschel mixer, a coffee mill or a food processor.

(j) Step of Adding External Additives:

This step is an optional step performed as needed when external additives are added to the toner particles.

The above toner particles can be used as a toner without adding any additive. However, the toner particles may be used with external additives such as a flowability improver and a cleaning aid added thereto, in order to improve flowability, charge property, cleanability, etc.

A combination of various external additives may be used.

The total amount of the external additives added is preferably 0.05 to 5 parts by mass, more preferably 0.1 to 3 parts by mass per 100 parts by mass of the toner particles.

The mixer used for the external additives may be a mechanical mixer such as a Henschel mixer or a coffee mill.

In the toner of the present invention, the toner particles contain the crystalline polyester resins having melting points within a specific range, and this basically provides low-temperature fixability. The toner of the present invention contains the first domain phase having a large average diameter and the second domain phase independent of the first domain phase and having a small average diameter. During heat fixation, temperature becomes sufficiently higher than the specific melting point range. In this case, the viscosities of the crystalline polyester resins A and B decrease significantly, and the crystalline polyester resins A and B that are not compatible with each other before heat fixation (for example, during production of the toner and storage of the toner) are suddenly allowed to dissolve in each other. The crystalline polyester resin B constituting the second domain phase with a small average diameter immediately dissolves in the vinyl resin, and this causes the crystalline polyester resin A to dissolve in the vinyl resin through the crystalline polyester resin B. More specifically, the crystalline polyester resin B constituting the second domain phase with a small average diameter functions as a compatibilizer for the vinyl resin and the crystalline polyester resin A constituting the first domain phase with a large average diameter. Therefore, the vinyl resin is plasticized by both the crystalline polyester resin A and the crystalline polyester resin B, and good low-temperature fixability is thereby obtained. As described above, the toner of the present invention contains the first domain phase with a large average diameter and the second domain phase with a small average diameter and independent of the first domain phase. This allows a difference to be made between the dissolution states of the resins before heat fixation and during heat fixation.

Since the crystalline polyester resins are included, as the immiscible domain phases, in the matrix phase composed of the vinyl resin, heat-resistant storage stability is obtained. When the size of a domain phase is small, this domain phase tents to show high compatibility with the vinyl resin serving as the main resin. However, when the content of the crystalline polyester resin A forming the first domain phase with a large average diameter is high, dissolution of the crystalline polyester resin B forming the second domain phase with a small average diameter into the vinyl resin does not impair heat-resistant storage stability. The dissolution of the crystalline polyester resin B serving as the compatibilizer is less likely to proceed by migration as compared to dissolution of a low-molecular weight material, so that high heat-resistant storage stability can be ensured for a long time.

In addition, since the crystalline polyester resins have dissolved in the vinyl resin to a large extent in an image after heat fixation, the crystalline polyester resins are less likely to be present as large domain phases, so that the occurrence of unevenness in gloss due to variations in size of the domain phases is suppressed.

The embodiment of the present invention has been specifically described. However, the embodiment of the present invention is not limited to the examples described above, and various modifications can be made thereto.

Examples

Specific Examples of the present invention will next be described, but the present invention is not limited thereto.

The volume-based median diameters of the fine vinyl resin particles, the fine colorant particles and the fine crystalline polyester resin particles were measured in the manner described above, and the molecular weights of the fine vinyl resin particles and the crystalline polyester resins were measured in the manner described above.

The glass transition point of the fine vinyl resin particles and the melting points of the crystalline polyester resins were measured in the manners described above.

The average diameters of the domain phases were measured in the manner described above.

The carboxy group concentration or ester group concentration in each resin was computed in the manner described above.

Production Example 1 of Toner:

(1) Preparation of Water-Based Dispersion [1] of Fine Vinyl Resin Particles:

First Polymerization:

A 1 L reaction vessel equipped with a stirrer, a temperature sensor, a condenser tube and a nitrogen introduction device was charged with 1.5 parts by mass of sodium polyoxyethylene (2) dodecyl ether sulfate and 560 parts by mass of ion exchanged water, and the temperature inside the vessel was increased to 80° C. while the mixture was stirred at a stirring rate of 300 rpm under nitrogen flow. After the temperature was increased, a solution prepared by dissolving 1.9 parts by mass of potassium persulfate in 37 parts by mass of ion exchanged water was added, and the temperature of the mixture was again increased to 80° C. A solution mixture of the following monomers was added dropwise over 1 hour, and the resultant mixture was heated to 90° C. and stirred for 2 hours to perform polymerization, whereby a dispersion [1a] of fine resin particles was prepared.

| | |
|---|---|
| Styrene | 113 parts by mass |
| n-Butyl acrylate | 32 parts by mass |
| Methacrylic acid | 13.6 parts by mass |

Second Polymerization:

A 5 L reaction vessel equipped with a stirrer, a temperature sensor, a condenser tube and a nitrogen introduction device was charged with a solution prepared by dissolving 7.4 parts by mass of sodium polyoxyethylene (2) dodecyl ether sulfate in 970 parts by mass of ion exchanged water, and the solution was heated to 98° C. Then 285 parts by mass of the dispersion [1a] of the fine resin particles and a solution mixture prepared by dissolving the following monomers at 90° C. were added, and the components were stirred and dispersed for 1 hour using a mechanical disperser having a circulation path "CLEARMIX" (manufactured by M Technique Co., Ltd.) to prepare a dispersion containing emulsified particles (oil droplets).

| | |
|---|---|
| Styrene | 284 parts by mass |
| n-Butyl acrylate | 92 parts by mass |
| Methacrylic acid | 15.7 parts by mass |
| n-Octyl-3-mercaptopropionate | 4.2 parts by mass |
| "HNP-0190" (manufactured by Nippon Seiro Co., Ltd.) | 120 parts by mass |

Then an initiator solution prepared by dissolving 6.6 parts by mass of potassium persulfate in 126 parts by mass of ion exchanged water was added to the obtained dispersion. The resultant system was heated at 84° C. and stirred for 1 hour to perform polymerization, and a dispersion [1b] of fine resin particles was thereby prepared.

Third Polymerization:

A solution prepared by dissolving 12 parts by mass of potassium persulfate in 290 parts by mass of ion exchanged water was further added, and a monomer solution mixture of 390 parts by mass of styrene, 180 parts by mass of n-butyl acrylate, 30 parts by mass of methacrylic acid and 8.6 parts by mass of n-octyl-3-mercaptopropionate was added dropwise over 1 hour under a temperature condition of 82° C. After completion of dropwise addition, the mixture was heated and stirred for 2 hours to perform polymerization. Then the mixture was cooled to 28° C. to obtain a water-based dispersion [1] of fine vinyl resin particles formed of vinyl resins.

In the obtained water-based dispersion [1] of the fine vinyl resin particles, the average diameter, i.e., the volume-based median diameter, of the fine vinyl resin particles was 220 nm. The glass transition temperature (Tg) thereof was 50° C., and the weight average molecular weight (Mw) was 31,000.

(2) Preparation of Water-Based Dispersion [Bk] of Fine Colorant Particles:

90 Parts by mass of sodium dodecyl sulfate was added to 1,600 parts by mass of ion exchanged water. 420 Parts by mass of carbon black (REGAL 330R, manufactured by Cabot Corporation) was gradually added to the obtained solution under stirring, and then the mixture was subjected to dispersion treatment using a stirrer "CLEARMIX" (manufactured by M Technique Co., Ltd.) to thereby prepare a water-based dispersion [Bk] of fine colorant particles.

The average particle diameter (the volume-based median diameter) of the fine colorant particles in the water-based dispersion [Bk] was 110 nm.

(3) Preparation of Water-Based Dispersion [A1] of Fine Crystalline Polyester Resin Particles:

(3-1) Synthesis of Crystalline Polyester Resin:

A three-neck flask was charged with 2,008 parts by mass of 1,12-dodecanediol (molecular weight: 202.33) and 3,438 parts by mass of decanedioic acid (molecular weight: 202.25). 4 Parts by mass of dibutyl tin oxide used as a catalyst and 2 parts by mass of hydroquinone were added, and the mixture was allowed to react at 160° C. in a nitrogen gas atmosphere for 5 hours. The reaction was further allowed to proceed at 8.3 kPa until a resin with a desired melting point is obtained, whereby a crystalline polyester resin [A1] was obtained.

The melting point (Tm) of the crystalline polyester resin [A1] was 86° C., and its number average molecular weight (Mn) was 7,500.

(3-2) Preparation of Water-Based Dispersion of Fine Crystalline Polyester Resin Particles:

Parts by mass of the crystalline polyester resin [A1] was melted, and the molten crystalline polyester resin [A1] was transferred to an emulsification disperser "CAVITRON CD1010" (manufactured by EUROTEC Co., Ltd.) at a transfer rate of 100 parts by mass per minute. At the same time as the transfer of the molten crystalline polyester resin [A1], diluted ammonia water having a concentration of 0.37% by mass and prepared by diluting 70 parts by mass of an ammonia water reagent with ion exchanged water in a water-based solvent tank was transferred to the emulsification disperser at a transfer rate of 0.1 L per minute while the diluted ammonia water was heated to 100° C. in a heat exchanger. The emulsification disperser was operated under the conditions of a rotor rotation speed of 60 Hz and a pressure of 5 kg/cm$^2$ to prepare a water-based dispersion [A1] of fine crystalline polyester resin particles having a volume-based median diameter of 200 nm. The solid content in the water-based dispersion [A1] was 30 parts by mass.

(4) Preparation of Water-Based Dispersion [B1] of Fine Crystalline Polyester Resin Particles:

(4-1) Synthesis of Crystalline Polyester Resin

A three-neck flask was charged with 2,008 parts by mass of 1,12-dodecanediol (molecular weight: 202.33) and 3,438 parts by mass of butanedioic acid (molecular weight: 118.09). 4 Parts by mass of dibutyl tin oxide used as a catalyst and 2 parts by mass of hydroquinone were added, and the mixture was allowed to react at 160° C. in a nitrogen gas atmosphere for 5 hours. The reaction was further allowed to proceed at 8.3 kPa until a resin with a desired melting point is obtained, whereby a crystalline polyester resin [B1] was obtained.

The melting point (Tm) of the crystalline polyester resin [B1] was 78° C., and its number average molecular weight (Mn) was 5,800.

(4-2) Preparation of Water-Based Dispersion of Fine Crystalline Polyester Resin Particles:

Parts by mass of the crystalline polyester resin [B1] was melted, and the molten crystalline polyester resin [B1] was transferred to an emulsification disperser "CAVITRON CD1010" (manufactured by EUROTEC Co., Ltd.) at a transfer rate of 100 parts by mass per minute. At the same time as the transfer of the molten crystalline polyester resin [B1], diluted ammonia water having a concentration of 0.37% by mass and prepared by diluting 70 parts by mass of an ammonia water reagent with ion exchanged water in a water-based solvent tank was transferred to the emulsification disperser at a transfer rate of 0.1 L per minute while the diluted ammonia water was heated to 100° C. in a heat exchanger. The emulsification disperser was operated under the conditions of a rotor rotation speed of 60 Hz and a pressure of 5 kg/cm$^2$ to prepare a water-based dispersion [B1] of fine crystalline polyester resin particles having a volume-based median diameter of 200 nm. The solid content in the water-based dispersion [B1] was 30 parts by mass.

(5) Formation of Toner Particles:

A stainless steel-made reaction vessel equipped with a stirrer, a temperature sensor and a condenser tube was charged with 364 parts by mass of the water-based dispersion [1] of the fine vinyl resin particles, 19 parts by mass of the water-based dispersion [B1] of the fine crystalline polyester resin particles, 347 parts by mass of ion exchanged water and 70 parts by mass (in terms of solids) of the water-based dispersion [Bk] of the fine colorant particles. After the temperature of the solution was adjusted to 25° C., a 5 mol/L aqueous sodium hydroxide solution was added to adjust the pH to 10.

Next, while the mixture was stirred at a stirring rate of 300 rpm, an aqueous solution prepared by dissolving 17 parts by mass of magnesium chloride hexahydrate in 17 parts by mass of ion exchanged water was added over 10 minutes, and then the temperature of the system was increased to 80° C. After the temperature was increased, 94 parts by mass of the water-based dispersion [A1] of the fine crystalline polyester resin particles was added dropwise over 20 minutes.

After completion of dropwise addition, the mixture was stirred at a stirring rate of 100 rpm, and the diameter of the particles was measured using a particle size distribution measuring device "Coulter Multisizer 3" (manufactured by Beckman Coulter, Inc.). When the volume-based median diameter reached 6.6 μm, the stirring rate was increased to 300 rpm, and an aqueous sodium chloride solution prepared by dissolving 33 parts by mass of sodium chloride in 130 parts by mass of ion exchanged water was added.

The mixture was further stirred under heating. When the circularity of the particles measured using a flow-type particle image analyzer "FPIA-2100" (manufactured by Sysmex) reached 0.946, the temperature inside the vessel was cooled to 25° C., whereby toner particles were obtained.

The thus-obtained dispersion of the toner particles was subjected to solid-liquid separation using a basket-type centrifuge "MARK III TYPE 60×40" (manufactured by Matsumoto Machine Manufacturing Co., Ltd.) to form a wet cake. The wet cake was repeatedly washed and subjected to solid-liquid separation in the basket-type centrifuge until the electric conductivity of the filtrate reached 15 μS/cm. Then air at a temperature of 4° C. and a humidity of 20% RH was blown using a "flash jet dryer" (manufactured by Seishin Enterprise Co., Ltd.) to dry the cake until the water content became 0.5% by mass.

1% By mass of hydrophobic silica particles and 1.2% by mass of hydrophobic titanium oxide were added to the dried toner particles, and these particles were mixed using a Henschel mixer for 20 minutes under the condition of a peripheral speed of a rotary blade of 24 m/s and were caused to pass through a 400 mesh sieve to thereby add the external additives, whereby a toner [1] was obtained.

For the obtained toner [1], cross sections of the toner particles stained with ruthenium (VIII) oxide were observed under a transmission electron microscope (TEM) using a measurement method known per se in the art, and domain phases brighter than a matrix phase were observed in the matrix phase. The domain diameters of 200 islands of the domain phases in the TEM image were measured, and the number distribution of the domain diameters was computed. The number distribution had one peak in a small-diameter region and one peak in a large-diameter region. Curve fitting was performed on the number distribution under the assumption that each peak followed a normal distribution. A larger one of the peak top values of the fitted curves was used as the average diameter of the first domain phase originating from the crystalline polyester resin A, and a smaller one was used as the average diameter of the second domain phase originating from the crystalline polyester resin B. The average diameter of the first domain phase originating from the crystalline polyester resin A was 600 nm, and the average diameter of the second domain phase originating from the crystalline polyester resin B was 100 nm. Cross sections of the unstained toner particles were observed under a transmission electron microscope (TEM) using a measurement method known per se in the art, and a domain phase was observed in the matrix phase. This domain phase may be a third domain phase originating from the parting agent. The average diameter of the third domain phase originating from the parting agent was 1.1 μm.

The addition of the external additives to the toner [1] did not change the shape and diameter of the toner particles.

Production Examples 2 to 24 of Toner:

Toners [2] to [24] were obtained in the same manner as in Production Example 1 of the toner except that the types of respective water-based dispersions were changed as shown in TABLE 1 and the contents of the respective resins were changed as shown in TABLE 1.

Each of the water-based dispersions [2] to [6] of fine vinyl resin particles in TABLE 1 was obtained by changing the composition of the monomers used in (1) preparation of water-based dispersion [1] of fine resin particles in Production Example 1 of toner to one of compositions shown in TABLE 2.

Each of the water-based dispersions [A2] to [A6] of fine crystalline polyester resin particles in TABLE 1 was obtained by changing the composition of the monomers used in (3-1) synthesis of crystalline polyester resin in Production Example 1 of toner to one of compositions shown in TABLE 3.

Each of the water-based dispersions [B2] to [B7] of fine crystalline polyester resin particles in TABLE 1 was obtained by changing the composition of the monomers used in (4-1) synthesis of crystalline polyester resin in Production Example 1 of toner to one of compositions shown in TABLE 4.

A water-based dispersion [X] in the second domain phase column in TABLE 1 was produced in the following preparation example.

Preparation of Water-Based Dispersion [X] of Fine Amorphous Resin Particles:

A four-neck flask equipped with a nitrogen introduction tube, a dewatering tube, a stirrer and a thermocouple was charged with 285.7 parts by mass of a 2-mole propylene oxide adduct of bisphenol A, 66.9 parts by mass of terephthalic acid, 47.4 parts by mass of fumaric acid and 1.43 parts by mass of an esterification catalyst (tin octylate), and the mixture was subjected to a condensation polymerization reaction at 230° C. for 8 hours, allowed to further react at 8 kPa for 1 hour and cooled to 160° C. Then a mixture of 20 parts by mass of acrylic acid, 240 parts by mass of styrene, 60 parts by mass of butyl acrylate and 16 parts by mass of a polymerization initiator (di-t-butyl peroxide) was added dropwise over 1 hour through a dropping funnel. After dropwise addition, while the temperature was maintained at 160° C., an addition polymerization reaction was continuously performed for 1 hour. Then the temperature was increased to 200° C., and the mixture was held at 10 kPa for 1 hour. Then styrene and butyl acrylate were removed, and an amorphous resin [x] was thereby obtained.

100 Parts by mass of the obtained amorphous resin [x] was pulverized using "Roundel Mill type RM" (manufactured by TOKUJU CORPORATION) and mixed with 638 parts by mass of a sodium lauryl sulfate solution having a concentration of 0.26% by mass and prepared in advance. The amorphous resin [x] was ultrasonically dispersed for 30 minutes using an ultrasonic homogenizer "US-150T" (manufactured by NIHONSEIKI KAISHA LTD.) at V-LEVEL and 300 μA under stirring, whereby a water-based dispersion [X] of fine amorphous resin particles having a volume-based median diameter of 180 nm was produced.

TABLE 1

| | MATRIX PHASE | | FIRST DOMAIN PHASE | | | SECOND DOMAIN PHASE | | |
|---|---|---|---|---|---|---|---|---|
| TONER NO. | WATER-BASED DISPERSION NO. OF FINE VINYL RESIN PARTICLES | CONTENT (% BY MASS) | WATER-BASED DISPERSION NO. OF FINE CRYSTALLINE POLYESTER RESIN PARTICLES | CONTENT (% BY MASS) | AVERAGE DIAMETER (nm) | WATER-BASED DISPERSION NO. OF FINE CRYSTALLINE POLYESTER RESIN PARTICLES | CONTENT (% BY MASS) | AVERAGE DIAMETER (nm) |
| TONER [1] | [1] | 82 | [A1] | 15 | 600 | [B1] | 3 | 100 |
| TONER [2] | [2] | 82 | [A1] | 15 | 500 | [B1] | 3 | 50 |
| TONER [3] | [3] | 82 | [A1] | 15 | 850 | [B1] | 3 | 150 |
| TONER [4] | [4] | 82 | [A1] | 15 | 400 | [B1] | 3 | 50 |
| TONER [5] | [1] | 82 | [A2] | 15 | 450 | [B1] | 3 | 100 |
| TONER [6] | [1] | 82 | [A3] | 15 | 850 | [B1] | 3 | 100 |
| TONER [7] | [1] | 82 | [A1] | 15 | 600 | [B2] | 3 | 50 |
| TONER [8] | [1] | 82 | [A1] | 15 | 600 | [B3] | 3 | 200 |
| TONER [9] | [1] | 82 | [A2] | 15 | 400 | [B3] | 3 | 50 |
| TONER [10] | [1] | 82 | [A1] | 15 | 600 | [B4] | 3 | 100 |
| TONER [11] | [1] | 80 | [A1] | 15 | 600 | [B1] | 5 | 100 |
| TONER [12] | [1] | 78 | [A1] | 15 | 550 | [B1] | 7 | 150 |
| TONER [13] | [1] | 85 | [A1] | 15 | 600 | — | 0 | — |
| TONER [14] | [1] | 85 | [B1] | 15 | 100 | — | 0 | — |
| TONER [15] | [6] | 85 | [A1] | 15 | 550 | — | 0 | — |
| TONER [16] | [1] | 82 | [A1] | 15 | 600 | [X] | 3 | 200 |
| TONER [17] | [1] | 82 | [A1] | 15 | 600 | [B7] | 3 | 150 |
| TONER [18] | [1] | 82 | [A4] | 15 | 350 | [B1] | 3 | 100 |
| TONER [19] | [1] | 82 | [A5] | 15 | 1000 | [B1] | 3 | 100 |
| TONER [20] | [1] | 82 | [A1] | 15 | 600 | [B5] | 3 | * |
| TONER [21] | [1] | 82 | [A1] | 15 | 600 | [B6] | 3 | 300 |
| TONER [22] | [5] | 82 | [A1] | 15 | 950 | [B1] | 3 | 250 |

TABLE 1-continued

| TONER NO. | MATRIX PHASE: WATER-BASED DISPERSION NO. OF FINE VINYL RESIN PARTICLES | MATRIX PHASE: CONTENT (% BY MASS) | FIRST DOMAIN PHASE: WATER-BASED DISPERSION NO. OF FINE CRYSTALLINE POLYESTER RESIN PARTICLES | FIRST DOMAIN PHASE: CONTENT (% BY MASS) | FIRST DOMAIN PHASE: AVERAGE DIAMETER (nm) | SECOND DOMAIN PHASE: WATER-BASED DISPERSION NO. OF FINE CRYSTALLINE POLYESTER RESIN PARTICLES | SECOND DOMAIN PHASE: CONTENT (% BY MASS) | SECOND DOMAIN PHASE: AVERAGE DIAMETER (nm) |
|---|---|---|---|---|---|---|---|---|
| TONER[23] | [4] | 82 | [A2] | 15 | 350 | [B1] | 3 | 50 |
| TONER[24] | [1] | 82 | [A6] | 15 | 800 | [B1] | 3 | 100 |

* Only one peak appeared in the number distribution of the domain diameter, so it was assumed that the resin constituting the second domain phase had dissolved in the matrix phase.

TABLE 2

| WATER-BASED DISPERSION NO. OF FINE VINYL RESIN PARTICLES | FIRST POLYMERIZATION: AMOUNT OF MONOMER USED (PARTS BY MASS) St | BA | MAA | SECOND POLYMERIZATION: AMOUNT OF MONOMER USED (PARTS BY MASS) St | BA | MAA | COMPATIBILIZER: INTRODUCTION AMOUNT (PARTS BY MASS) | TYPE |
|---|---|---|---|---|---|---|---|---|
| WATER-BASED DISPERSION (1) | 113 | 32 | 13.6 | 284 | 92 | 15.7 | NONE | — |
| WATER-BASED DISPERSION (2) | 113 | 32 | 13.6 | 284 | 92 | 15.7 | NONE | — |
| WATER-BASED DISPERSION (3) | 113 | 32 | 13.6 | 284 | 92 | 15.7 | NONE | — |
| WATER-BASED DISPERSION (4) | 113 | 32 | 13.6 | 284 | 92 | 15.7 | NONE | — |
| WATER-BASED DISPERSION (5) | 113 | 32 | 13.6 | 284 | 92 | 15.7 | NONE | — |
| WATER-BASED DISPERSION (6) | 113 | 32 | 13.6 | 284 | 92 | 15.7 | 100 | STEARYL STEARATE |

| WATER-BASED DISPERSION NO. OF FINE VINYL RESIN PARTICLES | THIRD POLYMERIZATION AMOUNT OF MONOMER USED (PARTS BY MASS) St | BA | MAA | CARBOXY GROUP CONCENTRATION (mmol/g) | Tg (° C.) | Mw |
|---|---|---|---|---|---|---|
| WATER-BASED DISPERSION (1) | 390 | 150 | 30 | 0.58 | 50 | 31,000 |
| WATER-BASED DISPERSION (2) | 364 | 158 | 48 | 0.77 | 52 | 31,000 |
| WATER-BASED DISPERSION (3) | 391 | 189 | 20 | 0.44 | 47 | 32,000 |
| WATER-BASED DISPERSION (4) | 360 | 186 | 54 | 0.85 | 53 | 30,000 |
| WATER-BASED DISPERSION (5) | 406 | 188 | 6 | 0.31 | 45 | 32,000 |
| WATER-BASED DISPERSION (6) | 300 | 150 | 30 | 0.58 | 46 | 31,000 |

※[St]→STYRENE
[BA]→BUTYL ACRYLATE
[MAA]→METHACRYLIC ACID

TABLE 3

| WATER-BASED DISPERSION NO. OF FINE CRYSTALLINE POLYESTER RESIN PARTICLES | POLYVALENT CARBOXYLIC ACID | POLYHYDRIC ALCOHOL | ESTER GROUP CONCENTRATION [mmol/g] | Tm (° C.) | Mn |
|---|---|---|---|---|---|
| [A1] | DODECANEDIOIC ACID | 1,12-DODECANEDIOL | 5.05 | 86 | 7,500 |
| [A2] | DECANEDIOIC ACID | 1,12-DODECANEDIOL | 5.43 | 82 | 7,000 |
| [A3] | DODECANEDIOIC ACID | 1,14-TETRADECANEDIOL | 4.72 | 91 | 7,600 |
| [A4] | DECANEDIOIC ACID | 1,10-DECANEDIOL | 5.88 | 70 | 6,700 |
| [A5] | DODECANEDIOIC ACID | 1,16-HEXADECANEDIOL | 4.42 | 95 | 8,200 |
| [A6] | OCTANEDIOIC ACID | 1,18-OCTADECANEDIOL | 4.73 | 102 | 7,600 |

TABLE 4

| WATER-BASED DISPERSION NO. OF FINE CRYSTALLINE POLYESTER RESIN PARTICLES | POLYVALENT CARBOXYLIC ACID | POLYHYDRIC ALCOHOL | ESTER GROUP CONCENTRATION [mmol/g] | Tm (° C.) | Mn |
|---|---|---|---|---|---|
| [B1] | BUTANEDIOIC ACID | 1,12-DODECANEDIOL | 7.02 | 78 | 5,800 |
| [B2] | DODECANEDIOIC ACID | 1,3-PROPANEDIOL | 7.40 | 65 | 5,500 |
| [B3] | DODECANEDIOIC ACID | 1,6-HEXANEDIOL | 6.41 | 69 | 6,300 |

TABLE 4-continued

| WATER-BASED DISPERSION NO. OF FINE CRYSTALLINE POLYESTER RESIN PARTICLES | POLYVALENT CARBOXYLIC ACID | POLYHYDRIC ALCOHOL | ESTER GROUP CONCENTRATION [mmol/g] | Tm (° C.) | Mn |
|---|---|---|---|---|---|
| [B4] | DECANEDIOIC ACID | 1,6-HEXANEDIOL | 7.04 | 62 | 6,000 |
| [B5] | DECANEDIOIC ACID | 1,4-BUTANEDIOL | 7.81 | 60 | 6,200 |
| [B6] | DECANEDIOIC ACID | 1,9-NONANEDIOL | 6.13 | 67 | 6,500 |
| [B7] | FUMARIC ACID | 1,6-HEXANEDIOL | 10.10 | 105 | 5,000 |

Production Examples 1 to 24 of Developer:

Developers [1] to [24] were produced by adding a ferrite carrier having a volume-based median diameter of 60 m and coated with a silicone resin to each of the toners [1] to [24] such that the concentration of the toner was 6% by mass and then mixing them using a V-type mixer.

Examples 1 to 12 and Comparative Examples 1 to 12

(1) Evaluation of Low-Temperature Fixability

Under Offsetting

Under offsetting is an image defect in which exfoliation of toner from a toner image on a transfer medium such as an image supporting medium occurs because melting of the toner layer by heat applied when the toner image passes through a fixation unit is insufficient.

Evaluation of under offsetting was performed using a commercial color multifunction printer "bizhub PRO C6500" (manufactured by Konica Minolta Inc.) with one of the above-produced developers installed in a development unit of the printer. The printer was modified such that fixation temperature, the toner adhesion amount and the system speed could be freely changed. Paper sheets used for the evaluation were "NPI 128 g/m$^2$" (manufactured by Nippon Paper Industries Co., Ltd.). A solid image with a toner adhesion amount of 8 g/m$^2$ was fixed at a fixation rate of 300 mm/sec. In this case, the temperature of a lower fixation roller was set to 100° C., and the temperature of an upper fixation belt was changed from 110 to 200° C. in steps of 5° C. A lowest fixable temperature of the upper fixation belt at which no under offsetting occurred was determined and used as the measure of low-temperature fixability. The lowest fixable temperature at that time was evaluated. Specifically, a developer with a lowest fixable temperature of 130° C. or lower was judged as pass. The results are shown in TABLE 5.

(2) Evaluation of Heat-Resistant Storage Stability 0.5 g of one of the toners was placed in a 10 mL glass bottle having an inner diameter of 21 mm, and the glass bottle was covered with a lid. The bottle was shaken using Tap Denser "KYT-2000" (manufactured by Seishin Enterprise Co., Ltd.) 600 times at room temperature. Then the toner was left to stand in an environment of a temperature of 57.5° C. and a humidity of 35% RH for 2 hours with the lid removed. Then the toner was placed with care on a 48 mesh sieve (aperture: 350 μm) such that the aggregates of the toner were not pulverized, and the sieve was placed on a "powder tester" (manufactured by Hosokawa Micron Group) and secured using a pressing bar and a knob nut. The strength of vibrations was adjusted such that a feed width was 1 mm, and vibrations were applied for 10 seconds. Then the ratio (% by mass) of the toner remaining on the sieve was measured. The heat-resistant storage stability was evaluated by the aggregation ratio of the toner represented by the following formula (A). A toner having an aggregation ratio of 15% or less was judged as pass. The results are shown in TABLE 5.

$$\text{aggregation ratio (\%) of toner} = \text{mass (g) of toner remaining on sieve}/0.5\text{ (g)} \times 100 \qquad \text{Formula (A)}$$

(3) Evaluation of Uniformity in Gloss

The uniformity in gloss was evaluated by the same method as the method of evaluating the low-temperature fixability described above except that a fixed image obtained by setting the temperature of the upper fixation belt to a temperature higher by 20° C. than the temperature at which under offsetting occurred was used. The uniformity in gloss was evaluated by observing the presence or absence of unevenness in gloss visually or under a loupe according to the following criteria. A toner with rank 3 or higher was judged as pass. The results are shown in TABLE 5.

—Evaluation Criteria—

5: No unevenness in gloss was detected even by observation under a microscope with a magnification of 100×.

4: No unevenness in gloss was detected even by observation under a loupe with a magnification of 20×.

3: Slight unevenness in gloss was detected by observation under a loupe with a magnification of 20×, but no unevenness in gloss was detected by visual observation. The unevenness in gloss was at a level not causing any problem in image quality.

2: Slight unevenness in gloss was detected by visual observation.

1: Unevenness in gloss was clearly detected by visual observation.

(4) Long-Term Storage Stability 0.5 g of one of the toners was placed in a 10 mL glass bottle having an inner diameter of 21 mm, and the glass bottle was covered with a lid. The bottle was shaken using Tap Denser "KYT-2000" (manufactured by Seishin Enterprise Co., Ltd.) 600 times at room temperature. Then the toner was left to stand in an environment of a temperature of 50° C. and a humidity of 85% RH for 24 hours with the lid removed. Then the toner was placed with care on a 48 mesh sieve (aperture: 350 μm) such that the aggregates of the toner were not pulverized, and the sieve was placed on a "powder tester" (manufactured by Hosokawa Micron Group) and secured using a pressing bar and a knob nut. The strength of vibrations was adjusted such that a feed width was 1 mm, and vibrations were applied for 10 seconds. Then the ratio (% by mass) of the toner remaining on the sieve was measured. The long-term storage stability of the toner was evaluated by the aggregation ratio represented by the above formula (A). A toner having an aggregation ratio of 15% or less was judged as pass. The results are shown in TABLE 5.

TABLE 5

| | TONER NO. | LOW-TEMPERATURE FIXABILITY (° C.) | HEAT RESISTANT STORAGE STABILITY (% BY MASS) | UNIFORMITY IN GLOSS (RANK) | LONG-TERM STORAGE STABILITY (% BY MASS) |
|---|---|---|---|---|---|
| EXAMPLE 1 | TONER[1] | 120 | 8 | 4 | 8 |
| EXAMPLE 2 | TONER[2] | 120 | 12 | 4 | 13 |
| EXAMPLE 3 | TONER[3] | 130 | 6 | 3 | 5 |
| EXAMPLE 4 | TONER[4] | 110 | 15 | 5 | 15 |
| EXAMPLE 5 | TONER[5] | 120 | 13 | 4 | 12 |
| EXAMPLE 6 | TONER[6] | 130 | 7 | 3 | 8 |
| EXAMPLE 7 | TONER[7] | 120 | 13 | 4 | 12 |
| EXAMPLE 8 | TONER[8] | 130 | 7 | 3 | 7 |
| EXAMPLE 9 | TONER[9] | 120 | 14 | 5 | 15 |
| EXAMPLE 10 | TONER[10] | 120 | 9 | 4 | 11 |
| EXAMPLE 11 | TONER[11] | 120 | 10 | 4 | 11 |
| EXAMPLE 12 | TONER[12] | 110 | 11 | 4 | 12 |
| COMPARATIVE EXAMPLE 1 | TONER[13] | 140 | 5 | 1 | 4 |
| COMPARATIVE EXAMPLE 2 | TONER[14] | 110 | 50 | 5 | 50 |
| COMPARATIVE EXAMPLE 3 | TONER[15] | 120 | 18 | 4 | 30 |
| COMPARATIVE EXAMPLE 4 | TONER[16] | 140 | 8 | 2 | 7 |
| COMPARATIVE EXAMPLE 5 | TONER[17] | 140 | 8 | 2 | 6 |
| COMPARATIVE EXAMPLE 6 | TONER[18] | 120 | 18 | 5 | 17 |
| COMPARATIVE EXAMPLE 7 | TONER[19] | 140 | 7 | 2 | 8 |
| COMPARATIVE EXAMPLE 8 | TONER[20] | 120 | 21 | 5 | 23 |
| COMPARATIVE EXAMPLE 9 | TONER[21] | 140 | 8 | 2 | 8 |
| COMPARATIVE EXAMPLE 10 | TONER[22] | 140 | 4 | 2 | 5 |
| COMPARATIVE EXAMPLE 11 | TONER[23] | 110 | 17 | 5 | 18 |
| COMPARATIVE EXAMPLE 12 | TONER[24] | 140 | 8 | 2 | 8 |

The invention claimed is:

1. A toner for electrostatic image development, comprising toner particles, wherein the toner particles have a domain-matrix structure in which a first domain phase comprising a crystalline polyester resin A and a second domain phase comprising a crystalline polyester resin B are dispersed in a matrix phase comprising a vinyl resin, an average diameter of the first domain phase is 400 to 900 nm, an average diameter of the second domain phase is 10 to 200 nm, and a melting point of the crystalline polyester resin A and a melting point of the crystalline polyester resin B are each 95° C. or lower.

2. The toner for electrostatic image development according to claim 1, wherein the vinyl resin has a carboxy group concentration of 0.4 to 0.8 mmol/g, the crystalline polyester resin A has an ester group concentration of 4.6 to 5.5 mmol/g, and the crystalline polyester resin B has an ester group concentration of 6.4 to 7.7 mmol/g.

3. The toner for electrostatic image development according to claim 2, wherein a difference between the ester group concentration in the crystalline polyester resin B and the ester group concentration in the crystalline polyester resin A is 1.0 to 3.0 mol/g.

4. The toner for electrostatic image development according to claim 2, wherein the vinyl resin has the carboxy group concentration of 0.5 to 0.7 mmol/g.

5. The toner for electrostatic image development according to claim 2, wherein the crystalline polyester resin A has the ester group concentration of 4.8 to 5.2 mmol/g.

6. The toner for electrostatic image development according to claim 2, wherein the crystalline polyester resin B has the ester group concentration of 6.5 to 7.2 mmol/g.

7. The toner for electrostatic image development according to claim 1, wherein a ratio of an amount of the crystalline polyester resin B with respect to a total amount of the resins constituting the toner particles is 2 to 5% by mass, and a ratio of the amount of the crystalline polyester resin B with respect to an amount of the crystalline polyester resin A is 10 to 25% by mass.

8. The toner for electrostatic image development according to claim 1, wherein a melting point of the crystalline polyester resin B is 65° C. or higher.

9. The toner for electrostatic image development according to claim 8, wherein the melting point of the crystalline polyester resin B is 65 to 80° C.

10. The toner for electrostatic image development according to claim 1, wherein the toner particles further include a third domain phase comprising a parting agent, the third domain phase being dispersed in the matrix phase.

11. The toner for electrostatic image development according to claim 1, wherein the average diameter of the first domain phase is 550 to 700 nm.

12. The toner for electrostatic image development according to claim 1, wherein the average diameter of the second domain phase is 20 to 120 nm.

13. The toner for electrostatic image development according to claim 1, wherein the toner for electrostatic image development is manufactured by an emulsion aggregation process.

14. The toner for electrostatic image development according to claim 1, wherein a ratio of an amount of the crystalline polyester resin A with respect to a total amount of the resins constituting the toner particles is 10 to 25% by mass.

15. The toner for electrostatic image development according to claim 1, wherein the melting point of the crystalline polyester resin A is 65 to 90° C.

16. The toner for electrostatic image development according to claim 1, wherein a glass transition point of the vinyl resin is 35 to 65° C.

* * * * *